US007026555B2

(12) United States Patent
Schomer et al.

(10) Patent No.: US 7,026,555 B2
(45) Date of Patent: Apr. 11, 2006

(54) COMPOSITE INSULATOR

(75) Inventors: Michael J. Schomer, Mount Prospect, IL (US); Victor Almgren, Chicago, IL (US); Scott Henricks, Prairie Grove, IL (US)

(73) Assignee: MacLean-Fogg Company, Mundelein, IL (US)

( * ) Notice: Subject to any disclaimer, the term of this patent is extended or adjusted under 35 U.S.C. 154(b) by 0 days.

(21) Appl. No.: 10/910,888

(22) Filed: Aug. 3, 2004

(65) Prior Publication Data

US 2005/0005442 A1 Jan. 13, 2005

Related U.S. Application Data

(63) Continuation of application No. 10/173,387, filed on Jun. 16, 2002.

(51) Int. Cl.
*H01B 17/38* (2006.01)

(52) U.S. Cl. ..... 174/142; 29/631; 174/152 GM

(58) Field of Classification Search ..... 29/631; 156/171, 172; 174/138 R, 140 H, 140 S, 174/141 C, 142, 152 GM, 152 R, 176–179, 174/193, 195–197, 209, 212
See application file for complete search history.

(56) References Cited

U.S. PATENT DOCUMENTS 4,197,348 A * 4/1980 Townsend ..... 156/171

* cited by examiner

*Primary Examiner*—Dean A. Reichard
*Assistant Examiner*—Adolfo Nino
(74) *Attorney, Agent, or Firm*—Dana Andrew Alden

(57) ABSTRACT

The present invention relates to a composite insulator comprising: (i) a composite body having at least two connectors, wherein the composite body is coupled to a conductor; and (ii) a housing, wherein the housing is a one-piece housing and the composite body is located inside the housing.

8 Claims, 9 Drawing Sheets

COMPOSITE INSULATOR

This application of a continuation of prior application Ser. No. 10/173,387, filed Jun. 16, 2002, the disclosure of which is hereby incorporated herein by reference.

FIELD OF THE INVENTION

This invention relates to composite insulators for electric power distribution systems.

BACKGROUND OF THE INVENTION

Insulators have been made with various materials. For example, insulators have been made of a ceramic or porcelain material. The ceramic and porcelain insulators, however, are heavy and bulky; they require specialized assembly fixtures or processes and are awkward and difficult to handle and ship. The ceramic insulators are brittle and easily chipped or broken.

As noted in application Ser. No. 10/173,386, filed on Jun. 16, 2002, entitled "Composite Insulator for Fuse Cutout," the disclosure of which is incorporated herein by reference, problems have arisen with electrical insulators. One such problem occurs when electricity flashes directly from a conducting surface to a grounded surface. This phenomenon is referred to as "flashover." The electricity travel gap between the conducting surface and the grounded surface is called the "strike distance."

Another problem occurs when the electrical current travels or "creeps" along the surface of the insulator. "Creep" results when the insulator has an inadequate surface distance. This may occur when water, dirt, debris, salts, airborne material, and air pollution is trapped at the insulator surface and provide an easier path for the electrical current. This surface distance may also be referred to as the "leakage," "tracking," or "creep" distance.

Because of these problems, insulators must be made of many different sizes so as to provide different strike and creep distances, as determined by operating voltages and environmental conditions. The strike distance in air is known, thus insulators must be made of various sizes in order to increase this distance and match the appropriate size insulator to a particular voltage. Creep distance must also be increased as voltage across the conductor increases so that flashover can be prevented.

Plastic or polymeric insulators have been designed to overcome some of the problems with conventional insulators. However, none of the prior plastic insulators have solved some or all of the problems simultaneously. For example, polymeric insulators have been made with "fins" or "sheds" which require time and labor for assembly. U.S. Pat. No. 4,833,278 to Lambeth, entitled "Insulator Housing Made From Polymeric Materials and Having Spirally Arranged Inner Sheds and Water Sheds," the disclosure of which is hereby incorporated herein by reference, discloses a resin bonded fiber tube made through filament winding (Col 5, ll. 15–17) with spiral ribs of fiberglass and resin to support a series of circular "sheds" (Col. 5, ll. 28–31; see also FIG. 1).

Other insulators require a complicated assembly of metal end fittings. For example, an electrical insulator is disclosed in U.S. Pat. No. 4,440,975 to Kaczerginski, entitled "Electrical Insulator Including a Molded One-Piece Cover Having Plate-like Fins with Arcuately Displaced Mold Line Segments," the disclosure of which is incorporated herein by reference. However, the insulator of Kaczerginski involves a more complicated assembly of two end pieces and an insulating rod of an undisclosed material. Col. 1, ll. 66–68. Similarly, in U.S. Pat. No. 4,246,696 to Bauer et al., the disclosure of which is incorporated herein by reference, an insulator having a prefabricated glass fiber rod manufactured through a pultrusion process is disclosed. Col. 3, ll. 47–49. Yet, the insulator of Bauer et al. requires a complicated attachment of metallic suspension fittings by fanning out the fiber reinforced stalk or by forcing the fittings on by pressure. Col. 3, line 67 to Col. 4, line 2.

Therefore, there exists a need for simple design that facilitates ease in the manufacture of the many different-sized cutouts and insulators the electrical power industry requires. There also exists a need for a lighter insulator that allows for greater ease in handling and shipping. Further, there exists a need for an insulator, which will not trap water, dirt, debris, salts, and air-borne material and thereby reduce the effective creep distance. Finally, there exists a need for a stronger insulator, which will not chip or break during shipping and handling.

The present invention is directed to overcoming these and other disadvantages inherent in prior-art systems.

SUMMARY OF THE INVENTION

The scope of the present invention is defined solely by the appended claims, and is not affected to any degree by the statements within this summary. Briefly stated, a composite insulator embodying features of the present invention comprises (i) a composite body having at least two connectors, wherein the composite body is coupled to a conductor; and (id) a housing, wherein the housing is a one-piece housing and the composite body is located inside the housing.

DETAILED DESCRIPTION OF THE PRESENTLY PREFERRED EMBODIMENT

Figure 1:
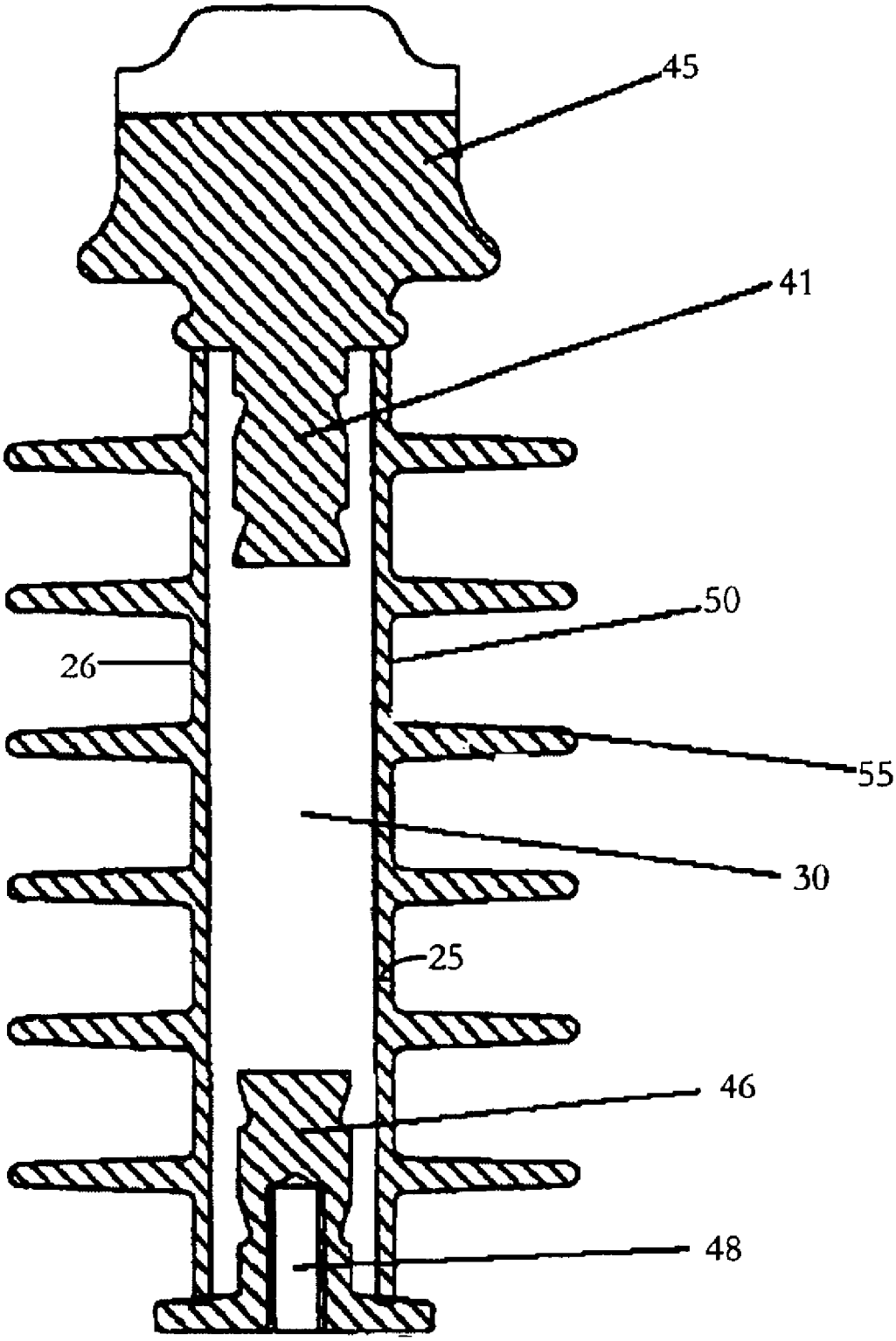
FIG. 1 depicts a cross-sectional view of an embodiment of a composite insulator with an F-neck and a tapped stud base as connectors.
Figure 2:
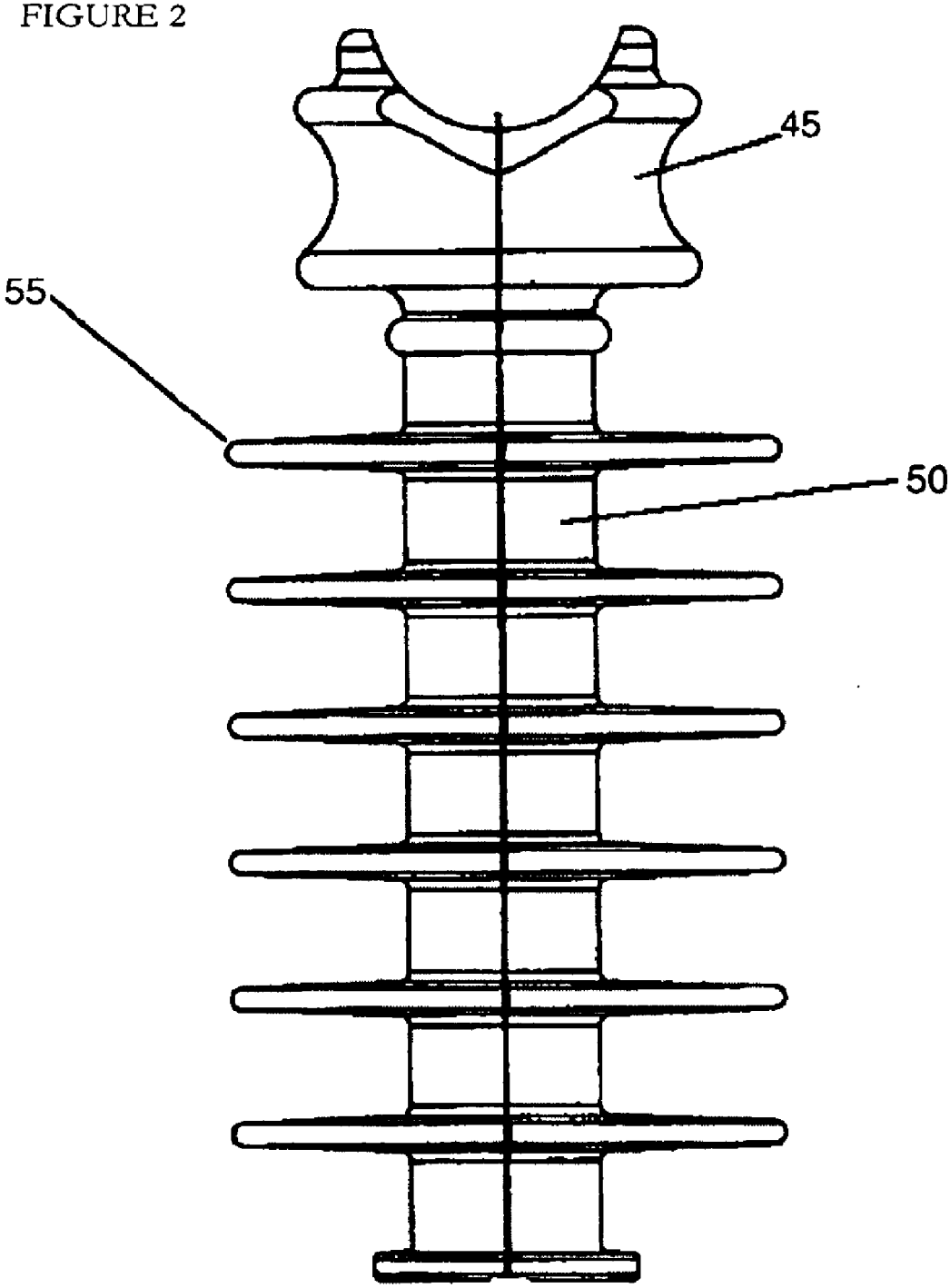
FIG. 2 depicts a view of the outside of an embodiment of a composite insulator with an F-neck and a tapped stud base as connectors.
Figure 3:
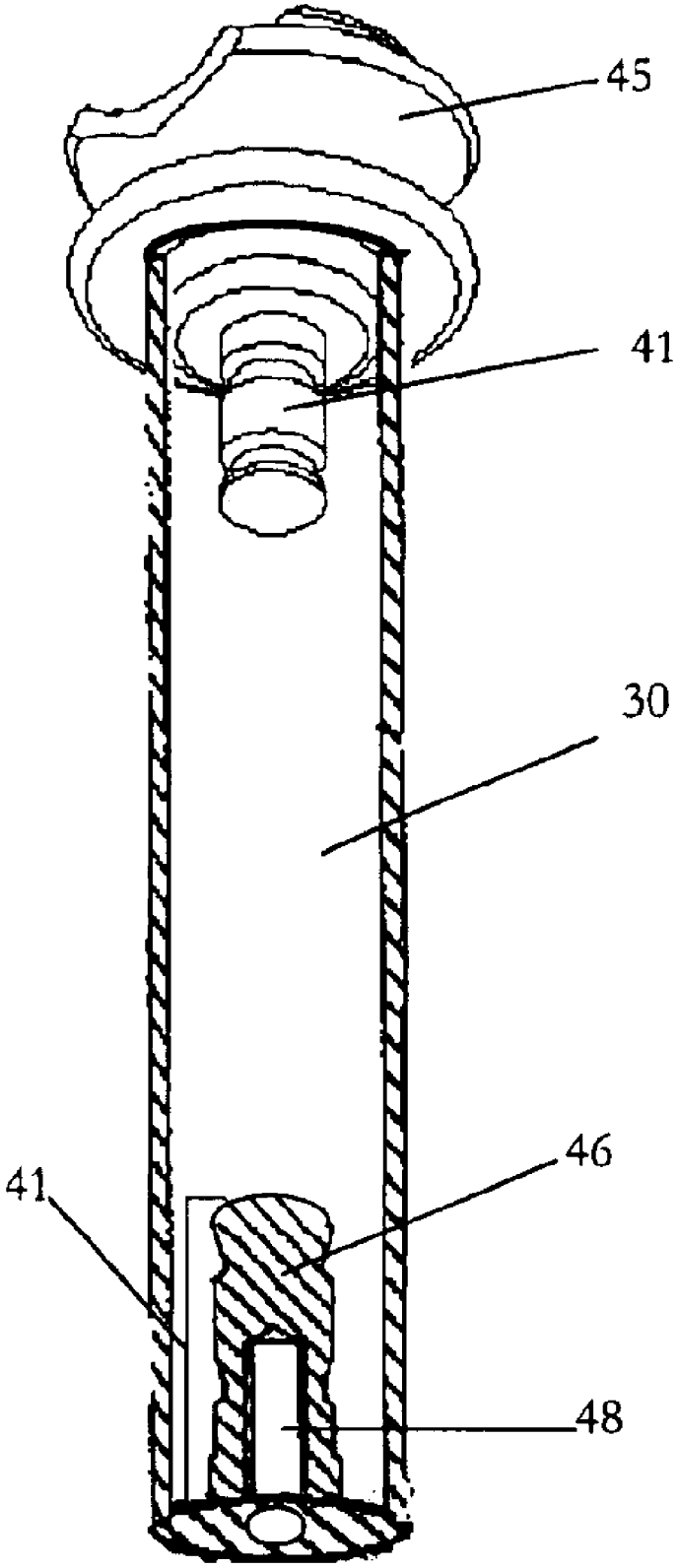
FIG. 3 depicts a cross sectional view of an embodiment of a body for a composite insulator with an F-neck and a tapped stud base as connectors.

The drawings show various embodiments of an insulator according to the present invention. FIGS. 1, 2, and 3 constitute a preferred embodiment of the present invention, comprising an insulator having a body 30 with a plurality of connectors and a housing 50.

The preferred embodiment of the present invention is provided with a plurality of connectors. According to one aspect of the present invention, the connector is a support connector that supports the body 30 when it is mounted on a utility structure, such as a utility pole or cross arm. According to another aspect of the present invention, the connector is one of a plurality of end connectors that couple the body 30 to a conductor. According to yet another aspect of the present invention, the connector couples the body 30 to ground.

Figure 5:
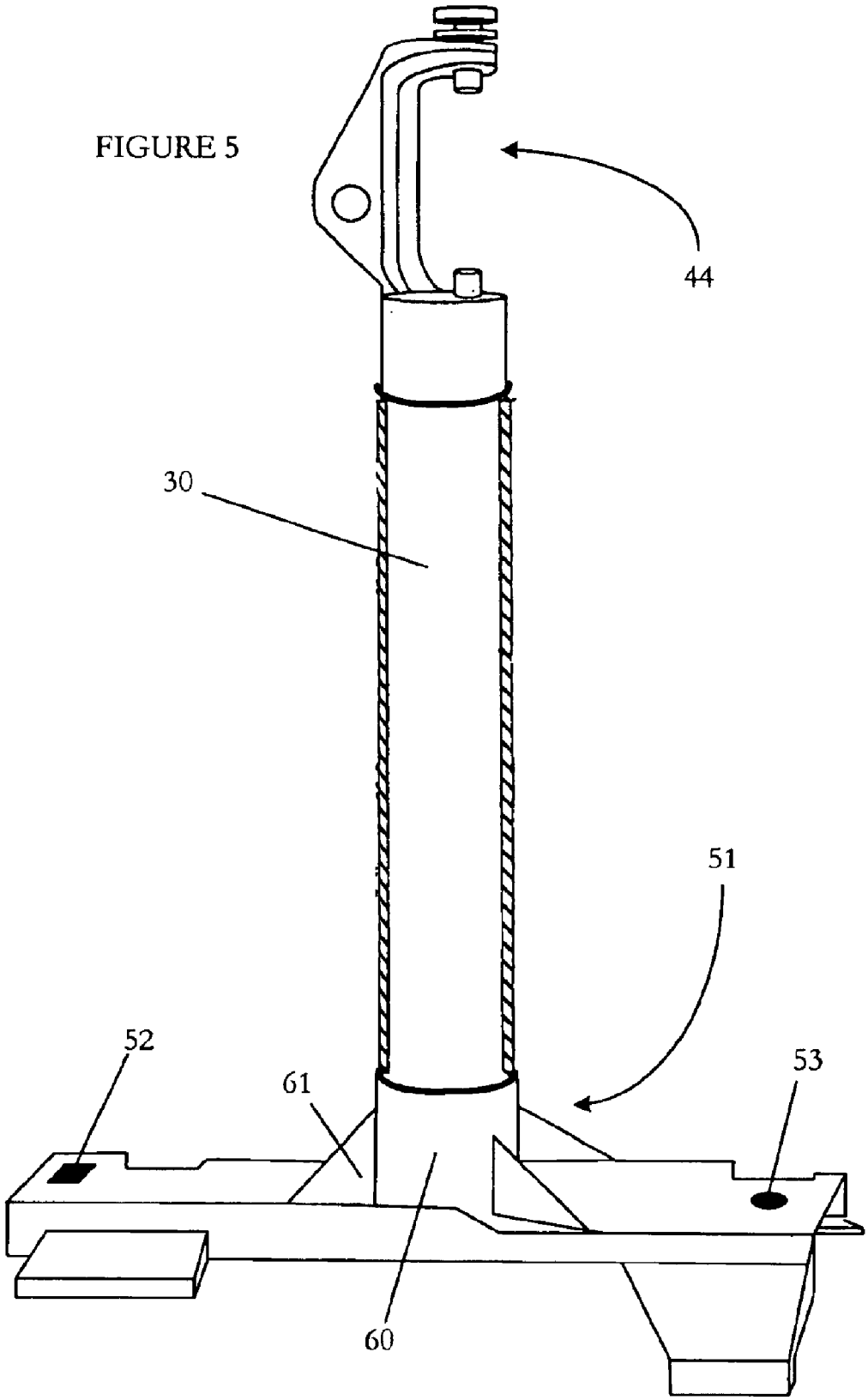
FIG. 5 depicts an embodiment of a body for a composite insulator with a "C" shaped connector and a bracket.
Figure 6:
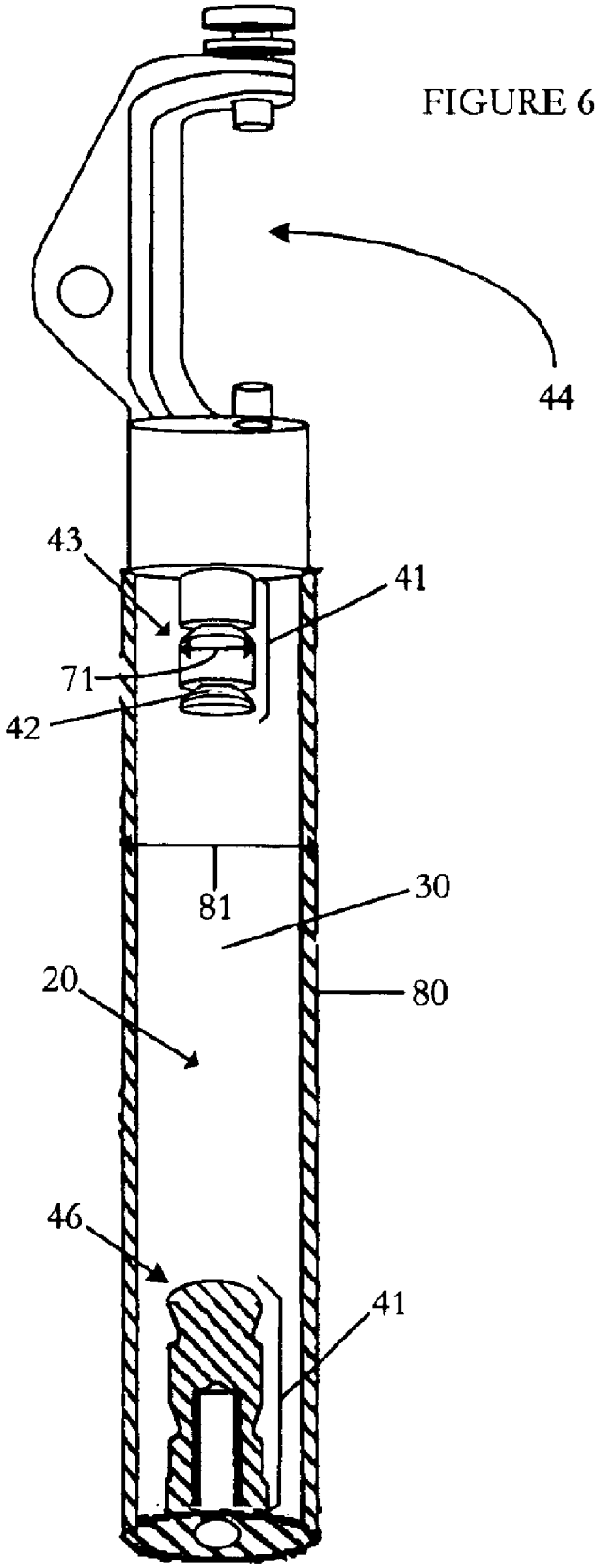
FIG. 6 depicts cross-sectional view of an embodiment of a body for a composite insulator with a "C" shaped connector and a tapped stud base connector.
Figure 7:
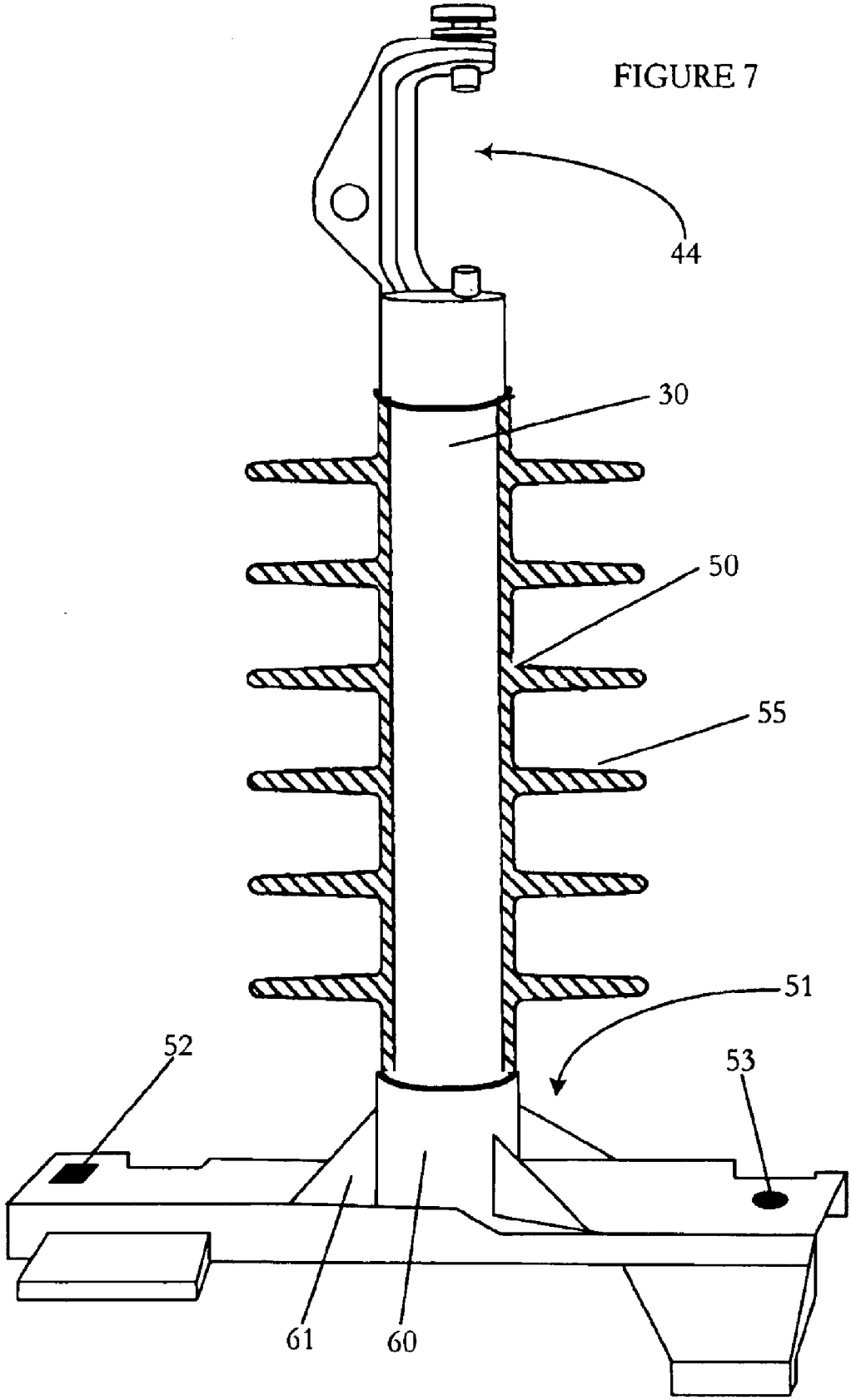
FIG. 7 depicts an embodiment of a composite insulator with a "C" shaped connector and a bracket.

Those skilled in the art will appreciate that the body 30 can be coupled to a conductor via a number of end connector configurations. FIGS. 5, 6, and 7 depict end connector 44 configured in the shape of a "C." FIGS. 1, 2, and 3 depict an end connector 45 with a configuration known in the art as an "F-Neck." FIGS. 8 and 9 depict an end connector 47 configured in the shape of a "U."

Figure 8:
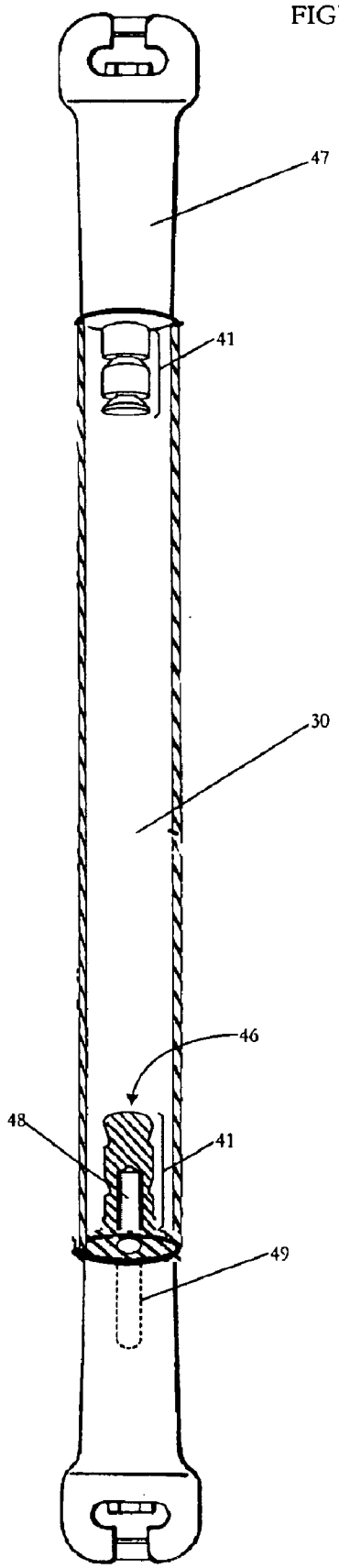
FIG. 8 depicts a cross-sectional view of an embodiment of a body for a composite insulator with a "U" shaped connector configured to work with a tapped stud base.
Figure 9:
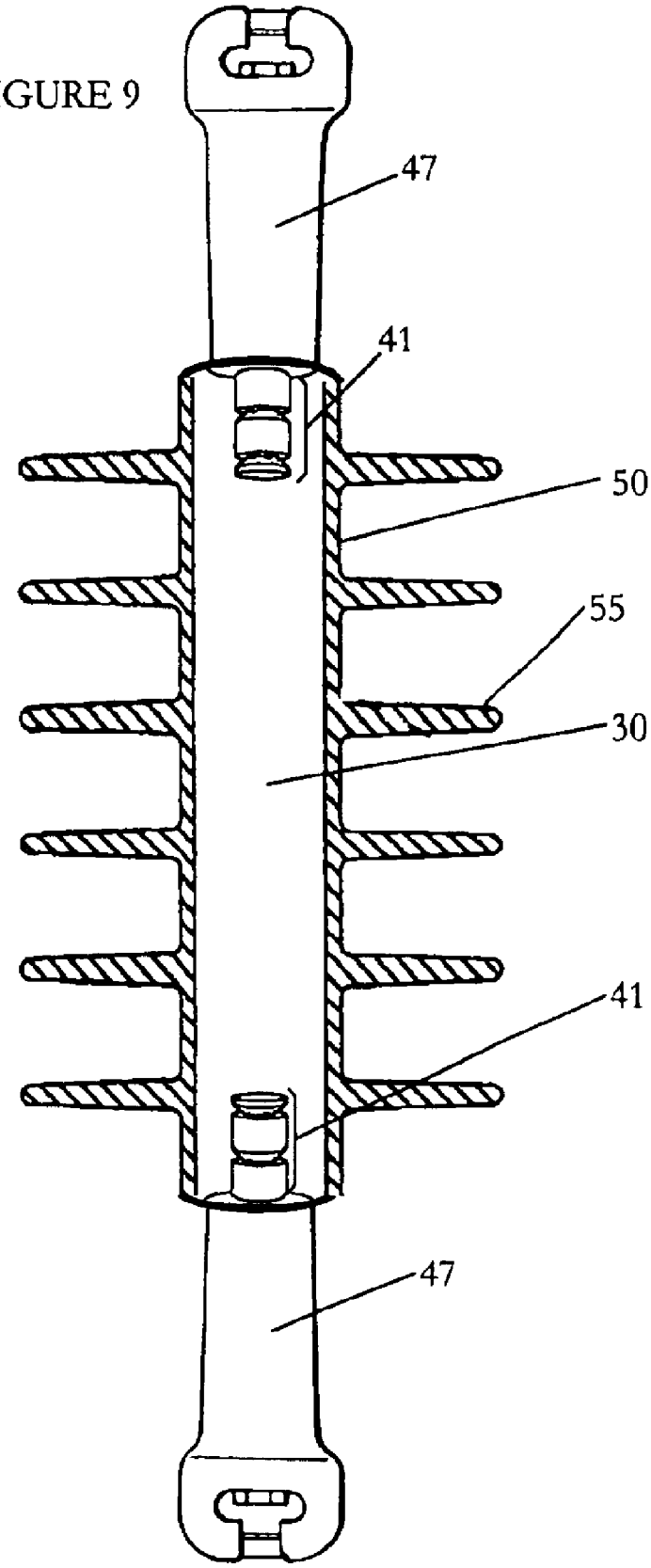
FIG. 9 depicts a cross-sectional view of an embodiment of a composite insulator with "U" shaped connectors.

FIGS. 3, 6, and 8 depict a tapped stud base 46 that includes a stud-receiving cavity 48; those skilled in the art will appreciate that the body 30 can be coupled to a conductor via any end connector configured to work with a stud 49. FIG. 8 illustrates an end connector configured to work with a stud 49.

Those skilled in the art will appreciate that the body 30 can be coupled to a utility structure via a number of support connector configurations. FIG. 7 depicts a supporting connector in a configuration known in the art as a bracket 51. In this embodiment, the tapped stud base 46 configuration is employed to attach the bracket 51 to the body 30. However, support connectors can be attached to the body 30 through other means. Holes 52, 53 are defined within the bracket 51 through which studs (not shown) are placed to couple the body 30 to a utility structure, such as a utility pole or cross arm.

In the preferred embodiment of the present invention, the connectors are formed of metal. According to one aspect of the present invention, the connectors 44, 45, 46, 47 are steel. According to another aspect of the present invention, the connectors 44, 45, 46, 47 are aluminum. According to yet another aspect of the present invention, the connectors 44, 45, 46, 47 are a metal alloy. According to still another aspect of the present invention, the connectors 44, 45, 46, 47 are made of a composite material.

In the preferred embodiment, the connectors are formed. In one aspect of the present invention, the connectors 44, 45, 46, 47 are forged. In another aspect, the connectors 44, 45, 46, 47 are machined. In still another aspect of the present invention, the connectors 44, 45, 46, 47 are cast.

The connectors 44, 45, 46, 47 are provided with a plurality of surfaces. As illustrated in FIGS. 5 and 6, in the preferred embodiment of the present invention, at least one of the connectors 44, 45, 46, 47 has an anchoring surface 41. The anchoring surface 41 has a conical surface 42 with a ridge surface 43 that is ridged in shape. As shown therein, the ridge surface 43 is provided with the diameter 71 that is smaller than an outer diameter 81 of the body 30. The anchoring surface 41 of the preferred embodiment allows for retention of the connector within the body 30.

Figure 4:
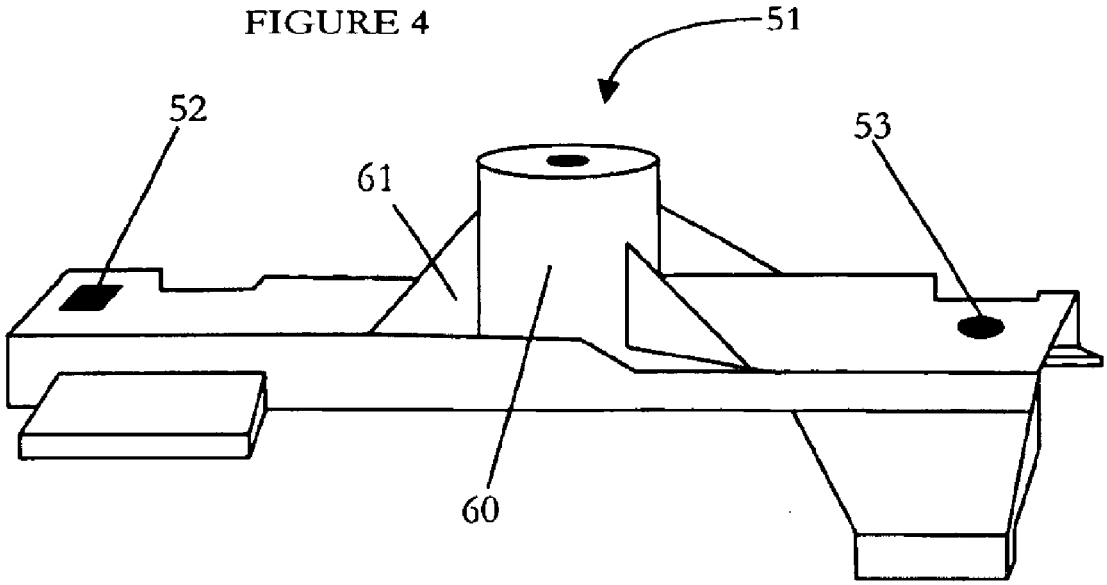
FIG. 4 depicts an embodiment of a bracket.

As depicted in FIGS. 4, 5, and 7, the connector 51 is provided with a generally cylindrical connector surface 60 and a plurality of projections 61. In the embodiment depicted, the projections 61 are generally triangular in shape and arranged radially from the generally cylindrical connector surface 60.

As illustrated in FIG. 8, the various connectors described herein can be used with one another. As illustrated in FIG. 8, a "U" shaped connector having an anchoring surface 41 can be used at one end of the body 30 while, at the other end, is a "U" shaped connector configured to work with a stud.

The end connectors of the present invention are not limited to the foregoing; so long as a connector serves at least the function of coupling the body 30 to a conductor, it is an end connector within the scope of the present invention. Furthermore, a supporting connector is not limited to the foregoing; as long as a connector serves at least the function of coupling the body 30 to a utility structure, it is a supporting connector within the scope of the present invention.

The body 30 is formed from a composite material. For the present invention, a composite material is any substance in the art that has electrically insulating properties, has sufficient rigidity to withstand the forces exerted by electric power lines, and is lighter per unit of volume than porcelain. The composite body of the preferred embodiment is made from materials which provide electrical insulating properties, preferably, a polymer. Other substances having electrically insulating properties may be used.

According to one aspect of the present invention, the composite material is a chemical compound, such as an organic compound, which is lighter per unit of volume than porcelain and composed of a single material. According to one aspect of the present invention, the composite material is a resin. According to another aspect of the present invention, the composite material is a polymer. According to another aspect of the present invention, the composite material is a plastic, such as thermoplastic or thermoset. According to yet another aspect of the present invention, the composite material is a polyester. According to still yet another aspect of the present invention, the composite material is an epoxy.

The composite material of the present invention is in a plurality of chemical combinations. According to one aspect of the present invention, the composite material is a mixture. According to another aspect of the present invention, the composite material is a mixture of a polymer and reinforcing materials.

The reinforcing material is in a plurality of shapes and configurations. According to one aspect of the present invention, the reinforcing material is in the shape of beads. In one embodiment, the reinforcing material is beads of glass. According to another aspect of the present invention, the reinforcing material is in a fibrous shape. In one embodiment of the present invention, the reinforcing material is glass fiber. Those skilled in the art will appreciate that the reinforcing material is composed of beads and fibers, and that any combination thereof can be used.

In one embodiment of the present invention, the reinforcing material is an insulating material such as glass. Those skilled in the art will appreciate that a composite material is a polymer mixed with glass. In another embodiment, the reinforcing material is an arimid. Those skilled in the art will also appreciate that a composite material is a polymer mixed with an ararmid.

According to one aspect of the present invention, a composite material is a polymer mixed with polyester. According to another aspect of the present invention, the composite material is a polymer mixed with a resin. According to yet another aspect of the present invention, the composite material is a polymer mixed with a plastic. According to still another aspect of the present invention, the composite material is a polymer mixed with an epoxy.

The mixture is not limited to the above, and a composite material is not limited to the foregoing description. So long as the material is a substance that has electrically insulating properties, has sufficient rigidity to withstand the forces exerted by electric power lines, and is lighter per unit of volume than porcelain it is a composite material within the scope of the present invention.

As depicted in FIGS. 1, 2, 3, and 4, the body 30 of the preferred embodiment is made with connectors 44, 45, 46, 47. According to one aspect of the present invention, the body 30 is made through an injection molding process known as insert molding. The preferred embodiment is made through insert molding and the use of a mold in a plurality of pieces. According to another aspect of the present invention, the body 30 is made with connectors 44, 45, 46, 47 through transfer molding. According to another aspect of the present invention, the body 30 is made with connectors 44, 45, 46, 47 through compression molding. According to yet another aspect of the present invention, the body 30 is made with connectors 44, 45, 46, 47 through casting.

The body 30 is composed of a plurality of shapes. As shown in FIG. 6, the body 30 is a hollow tube that encloses a cavity 20. Also shown, the body 30 is provided with an outer surface 80 that includes a generally cylindrical shape and the outer diameter 81. Those skilled in the art will appreciate that the body 30 can be composed of a plurality of cylindrical shapes having a plurality of radii. According to another aspect of the present invention, the body 30 is composed of a plurality of conical shapes. Again, those skilled in the art will appreciate that the body 30 can be composed of conical shapes having a plurality of radii.

The connectors of the preferred embodiment are integrated into the body 30. As shown in FIGS. 1–3 and 5–9, the connectors 45, 46 and the anchoring surface 41 are generally coaxial with the generally cylindrically shaped body 30. In making the body 30 of the preferred embodiment through use of a two-piece mold, the anchoring surface 41 of the connectors 45, 46 are placed in the mold. After the connectors 45, 46 are placed in the mold, the mold is closed. After the mold is closed, composite material is injected into the mold. After the composite material is injected, the mold is removed. The body 30 is then placed into the housing 50.

FIG. 2 depicts the housing 50 of the preferred embodiment of the present invention. The housing 50 of the present invention is a structure that houses the body 30. In the preferred embodiment depicted in FIG. 2, the housing 50 is made of silicone rubber. According to another aspect of the present invention, the housing 50 is made of an elastomer. According to yet another aspect of the present invention, the housing 50 is made of rubber. In another aspect of the present invention, the housing 50 is made of EPDM. In yet another aspect of the present invention, the housing 50 is made of room temperature vulcanized rubber ("RTV rubber"). According to yet another aspect of the present invention, the housing 50 is made of an alloy of rubber and elastomer materials.

The housing 50 of the preferred embodiment is a made through an injection molding process known as insert molding thereby yielding a one-piece housing. According to one aspect of the present invention, insert molding is accomplished through use of a mold in a plurality of pieces. According to one aspect of the present invention, the housing 50 is made through transfer molding. According to another aspect of the present invention, the housing 50 is made through compression molding. According to yet another aspect of the present invention, the housing 50 is made through casting.

As depicted in FIGS. 1, 7, and 9, the body 30 is situated inside the housing 50. In the presently preferred embodiment, the housing 50 is insert-molded around the body 30. The body 30 of the preferred embodiment is inserted into a housing defining element, preferably a two-piece mold, which has been previously shaped to form sheds 55; then, the mold is closed. To make the preferred embodiment depicted in FIG. 2, silicone rubber is injected into the mold so that the silicone rubber assumes the form of the housing 50 with sheds 55 extending from a shield layer 26 that includes a cylindrical thickness 25. In the preferred embodiment of the present invention, the sheds 55 increase the surface distance from one end of the housing 50 to the other.

While the housing 50 of the preferred embodiment is made through use of silicone rubber and a two-piece mold, other molds can be used. According to one aspect of the present invention, the mold is one piece. According to yet another aspect of the present invention, the mold is formed of a plurality of pieces. Those skilled in the art will appreciate that while the housing 50 of the preferred embodiment is formed from one mold, the housing of the present invention can be made with more than one mold.

The housing 50 of the present invention is not limited to the foregoing; so long as a structure houses the body 30, it is a housing within the scope of the present invention.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method for manufacturing an insulator comprising the steps of:

a) providing a body containing a polymer and a glass, the body being cylindrically shaped and enclosing a cavity;

b) providing a connector for assembly onto the body that has been cast and machined with an anchoring surface that is cylindrically shaped;

c) assembling the connector onto the body so that, after assembly, the connector and the body are generally coaxial;

d) providing a housing defining element previously shaped to form at least one shed;

e) arranging the body and the housing defining element in relation to each other so that a distance exists between the body and the housing defining element that corresponds to a cylindrical thickness of a shield layer; and f) ejecting rubber into the housing defining element so that the rubber forms a housing comprising the shield layer and at least one shed, whereby at least a portion of the body and at least a portion of the connector are located within the housing.

2. A method for manufacturing an insulator according to claim 1, wherein the anchoring surface of the connector includes a ridge surface.

3. A method for manufacturing an insulator according to claim 1, wherein the body includes an outer diameter and the anchoring surface of the connector includes a diameter that has been machined so that, at least before assembly onto the body, the diameter of the anchoring surface is smaller than the outer diameter of the body.

4. A method for manufacturing an insulator according to claim 1, further comprising the step of ejecting the rubber immediately onto the body so that the rubber flows onto the body.

5. A method for manufacturing an insulator according to claim 1, further comprising the step of ejecting the rubber so that the rubber substantially fills the distance between the housing defining element and the body.

6. A method for manufacturing an insulator according to claim 1, wherein a portion of the housing contacting the body is dimensioned according to the location of the housing defining element.

7. A method for manufacturing an insulator according to claim 1, wherein the rubber is ejected onto the body at a distance from a outer surface of the body that is substantially the same as the thickness of the housing.

8. A method for manufacturing an insulator according to claim 1, wherein the housing defining element has been shaped to form at least a portion of the shield layer.

* * * * *